US005268991A

United States Patent [19]

Tasaki

[11] Patent Number: 5,268,991

[45] Date of Patent: Dec. 7, 1993

[54] APPARATUS FOR ENCODING VOICE SPECTRUM PARAMETERS USING RESTRICTED TIME-DIRECTION DEFORMATION

[75] Inventor: Hirohisa Tasaki, Kanagawa, Japan

[73] Assignee: Mitsubishi Denki Kabushiki Kaisha, Tokyo, Japan

[21] Appl. No.: 662,929

[22] Filed: Feb. 28, 1991

[30] Foreign Application Priority Data

Mar. 7, 1990 [JP] Japan ..... 2-56235

[51] Int. Cl.[5] ..... G10L 9/02

[52] U.S. Cl. ..... 395/2.29; 395/2.31

[58] Field of Search ..... 381/29-46, 381/51; 395/2.29, 2.31; 341/106, 200; 375/25-27, 122; 358/133, 135, 136

[56] References Cited

U.S. PATENT DOCUMENTS

| | | | |
|---|---|---|---|
| 4,670,851 | 6/1987 | Murakami et al. | 358/136 |
| 4,868,867 | 9/1989 | Davidson et al. | 381/36 |
| 4,899,385 | 2/1990 | Ketchum et al. | 381/36 |
| 4,910,781 | 3/1990 | Ketchum et al. | 381/3 |
| 4,965,580 | 10/1990 | Tasaki et al. | 358/135 |

OTHER PUBLICATIONS

Tsao et al., "Shape-Gain Matrix Quantizer For LPC Speech", IEEE Transactions on Acoustics, Speech and Signal Processing, vol. ASSP-34, No. 6, Dec. 1986, pp. 1427-1438.

Shiraki et al. "LPC Speech Coding Based On Variable-Length Segments Quantization", IEEE Transactions On Acoustics, Speech And Signal Processing, vol. 36 No. 9, Sep. 1988, pp. 1437-1444.

Roucos et al., "A Segment Vocoder Algorithm For Real-Time Implementation", IEEE, 1987, pp. 1949-1952.

*Primary Examiner*—Michael R. Fleming
*Assistant Examiner*—Michelle Doerrler
*Attorney, Agent, or Firm*—Wolf, Greenfield & Sacks

[57] ABSTRACT

An apparatus for encoding voice spectrum envelop parameters forms a phoneme matrix by combining a certain number of phoneme vectors, and effects matrix quantization by using this phoneme matrix as a unit. The apparatus performs restricted time-direction deformation of an input phoneme matrix, such as by shifting, compression, or expansion in time-direction, to output a finite number of deformed phoneme matrices. The input phoneme matrix is formed by combining, in time-direction, a certain number of phoneme vectors composed of spectrum parameters representing information on the spectrum of an input voice signal. A code book is used for storing a second number of phoneme matrix code words which are compared with the deformed phoneme matrices provided by restricted time-direction deformation. The distances between the deformed phoneme matrices of the input phoneme matrix and the phoneme matrix code words, which are successively read out from the code book, are calculated. Distances calculated for each pair of deformed phoneme matrix and codebook phoneme matrix are compared and the phoneme matrix code words having the smallest distance are selected as an optimum phoneme matrix code word. The code word number of the optimum phoneme matrix code word is output from the apparatus.

20 Claims, 4 Drawing Sheets

PHONEME MATRIX

CODE WORD A

DISTANCE dA

CODE WORD B

DISTANCE dB

APPARATUS FOR ENCODING VOICE SPECTRUM PARAMETERS USING RESTRICTED TIME-DIRECTION DEFORMATION

BACKGROUND OF THE INVENTION

This invention relates to an apparatus for encoding voice spectrum envelop parameters which forms a phoneme matrix by combining a certain number of phoneme vectors, and which effects matrix quantization by using this phoneme matrix as a unit.

FIG. 1 is a block diagram of an example of a conventional voice spectrum envelop parameter encoder described on pages 1427–1439 of IEEE Transaction on Acoustic, Speech, and Signal Processing, volume ASSP-34, No. 6 (December, 1986).

Referring to FIG. 1, phoneme vectors which are parameters representing information on the spectrum envelop of an input voice and which are obtained by analyzing the input voice signal for a certain period of time (e.g., 10 msec) for each analysis frame are input through an input terminal 1. A phoneme matrix formation means 2 serves to form a phoneme matrix by combining, in time-direction, L phoneme vectors input through the input terminal 1. Finite M typical phoneme matrix code words are stored in a code book 3. A changeover switch 4 serves to successively read out M phoneme matrix code words stored in the code book 3.

A distance calculation means 5 serves to calculate the distance between the phoneme matrix supplied from the phoneme matrix formation means 2 and each of the phoneme matrix code words successively read from the code book 3 through the changeover switch 4. An optimum phoneme matrix code word selection means 6 serves to compare the distances calculated by the distance calculation means 5, to thereby select the phoneme matrix code word of the smallest distance value as an optimum phoneme matrix code word, and to output the number of the optimum phoneme matrix code word. The optimum phoneme matrix code word number is output through an output terminal 7.

The operation of this encoder will be described below. When phoneme vectors, i.e., parameters representing information on the spectrum envelop of an input voice are input through the input terminal 1, the phoneme matrix formation means 2 accumulates input phoneme vectors with respect to groups of certain L frames, and outputs a phoneme matrix composed of L phoneme vectors for each group of L frames. This phoneme matrix is supplied from the phoneme matrix formation means 2 to the distance calculation means 5. On the other hand, M phoneme matrix code words stored in the code book 3 are successively read out through the changeover switch 4 to be input into the distance calculation means 5.

The distance calculation means 5 successively calculates the distances between the phoneme matrix supplied from the phoneme matrix formation means 2 and the phoneme matrix code words successively supplied through the changeover switch 4. Euclidean distance, for example, is used as the measure for this distance calculation. The results of calculation are supplied to the optimum code word selection means 6 to be compared, and the phoneme matrix code word of the smallest distance value is selected as an optimum phoneme matrix code word. The code word number of this optimum phoneme matrix code word is output as an optimum phoneme matrix code word number through the output terminal 7 by the optimum code word selection means 6.

The decoder has the same code book as the above-described code book and has a reverse quantization means which receives the optimum phoneme matrix code word number, reads out a phoneme matrix code word thereby designated, decomposes the same into L output phoneme vectors, and outputs these vectors.

However, the optimum phoneme matrix code word having the smallest distance on the phoneme matrices does not always coincide with the phoneme matrix code word which is closest to the input voice in terms of phonemic characteristics. FIGS. 2(*a*) to (*c*) are diagrams of an example of such a case, which schematically show a phoneme matrix formed by combining phoneme vectors one-dimensionally for five frames. FIG. 2(*a*) shows a phoneme matrix to be encoded, FIG. 2(*b*) shows encoding of this matrix with a phoneme matrix code word A, and FIG. 2(*c*) shows encoding of this matrix with a different phoneme matrix code word B. The abscissa represents time while the ordinate represents the phoneme vector value.

As shown in these diagrams, in the case of coding with the phoneme matrix code word A, the synthesized voice does not maintain phonemic characteristics of the input voice well. In contrast, in the case of coding with the phoneme matrix code word B, the synthesized voice maintains phonemic characteristics of the input voice well, although a slight difference in time-direction is observed. However, with respect to the distance to the phoneme matrix which is the object of encoding, the distance dA from the phoneme matrix code word A is smaller than the distance dB from the phoneme matrix code word B. Accordingly, the phoneme matrix code word A is selected as an optimum phoneme matrix code word. The selection is greatly influenced by deformation in time-direction, and there is a substantially large possibility of selection of a phoneme matrix code word showing incorrect phonemic characteristics.

To solve this problem, a type of a system has been proposed in which the object phoneme matrix is encoded not on fixed time length but on variable time length, and in which information on the duration time of each phoneme matrix is transmitted along with the optimum matrix code number. An example of this system is reported in the voice study society materials of Nihon Onkyo Gakkai (data number S84-45, Nov. 22, 1985).

In this system, linear compression/expansion of phoneme matrix code words in the code book is effected by dynamic programming so that an optimum envelop is obtained with respect to a series of input phoneme vectors, the optimum phoneme matrix code word and the duration time of the same are selected to perform encoding. The distance at the time of encoding is thereby reduced so that the phonemic characteristics are suitably maintained.

The conventional voice spectrum envelop parameter encoders are constructed as described above. In the case of the encoder shown in FIG. 1, there is a substantially large possibility of selection of a phoneme matrix code word showing incorrect phonemic characteristics because of the influence of deformation in time-direction. The system in which information on the duration time of each phoneme matrix is transmitted along with the optimum matrix code word enables phonemic characteristics to be suitably maintained, but it cannot be directly applied to a real time communication system in which transmission is effected in fixed frame cycles, and it entails the problem of a very large amount of processing operation and, hence, the problem of an increase in delay time.

SUMMARY OF THE INVENTION

The present invention has been achieved to solve the above-described problems, and an object of the present invention is to provide an apparatus for encoding voice spectrum parameters which enables transmission in fixed frame cycles and which limits deterioration of the phonemic characteristics of the synthesized voice due to the influence of deformation in time-direction.

According to the present invention, there is provided an apparatus for encoding voice spectrum parameters, having a restricted time-direction deformation means for effecting finite N kinds of shifting/compression/expansion in time-direction for a phoneme matrix of an input voice signal. A distance calculation means is used to calculate the distances between the N deformed phoneme matrices output from the restricted time-direction deformation means and M phoneme matrix code words successively read out from a code book.

The restricted time-direction deformation means in accordance with the present invention processes the phoneme matrix of the input voice signal by finite N kinds of shifting/compression/expansion in time-direction previously given in a certain range such that the extent of deformation detected by auditory sense is small, thereby forming N deformed phoneme matrices. The distance calculation means receives the N deformed phoneme matrices output from the restricted time-direction deformation means, calculates the distances between the N deformed phoneme matrices and the M phoneme matrix code words successively read out from the code book, and outputs the distances calculated to an optimum code word selection means. An apparatus for encoding voice spectrum parameters is thereby realized which enables transmission in fixed frame cycles and which limits deterioration of the phonemic characteristics of the synthesized voice due to the influence of deformation in time-direction.

According to the present invention, a restricted time-direction deformation means is provided to process a phoneme matrix of an input voice signal by finite N kinds of time-direction shifting/compression/expansion previously given, and to thereby form N deformed phoneme matrices which are supplied to the distance calculation means, thereby obtaining a voice spectrum parameter encoder which enables transmission in fixed frame cycles and which limits deterioration of the phonemic characteristics of the synthesized voice due to the influence of deformation in time-direction. Also, according to the present invention, necessity of providing time-direction varieties of phoneme matrix code words stored in the code book is reduced, thereby enabling a reduction in the code book size.

DESCRIPTION OF THE PREFERRED EMBODIMENT

Figure 1:
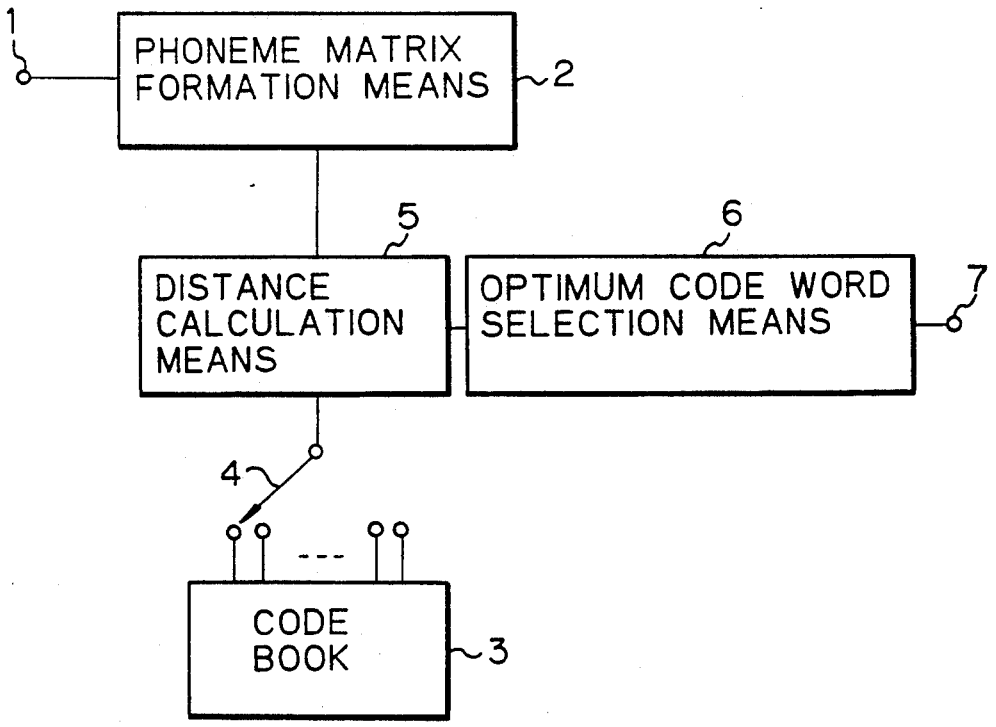
Fig. 1 (PRIOR ART)
FIG. 1 is a block diagram of a conventional voice spectrum envelop parameter encoder.
Figure 2A:
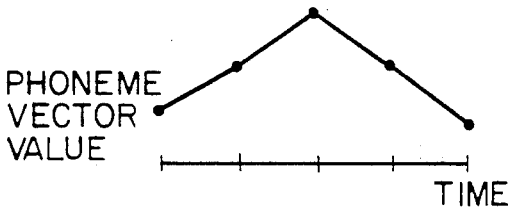
Fig. 2A (PRIOR ART)
FIGS. 2(*a*) to 2(*c*) are diagrams of the operation of the encoder shown in FIG. 1.
Figure 2B:
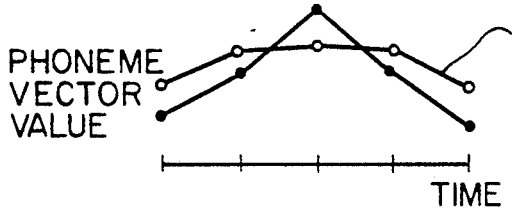
Fig. 2B (PRIOR ART)
Figure 2C:
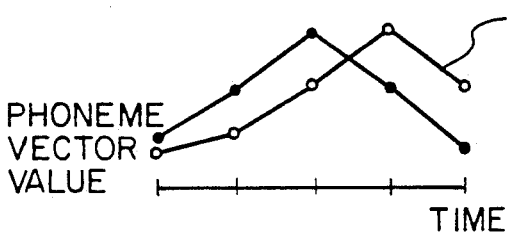
Fig. 2C (PRIOR ART)
Figure 3:
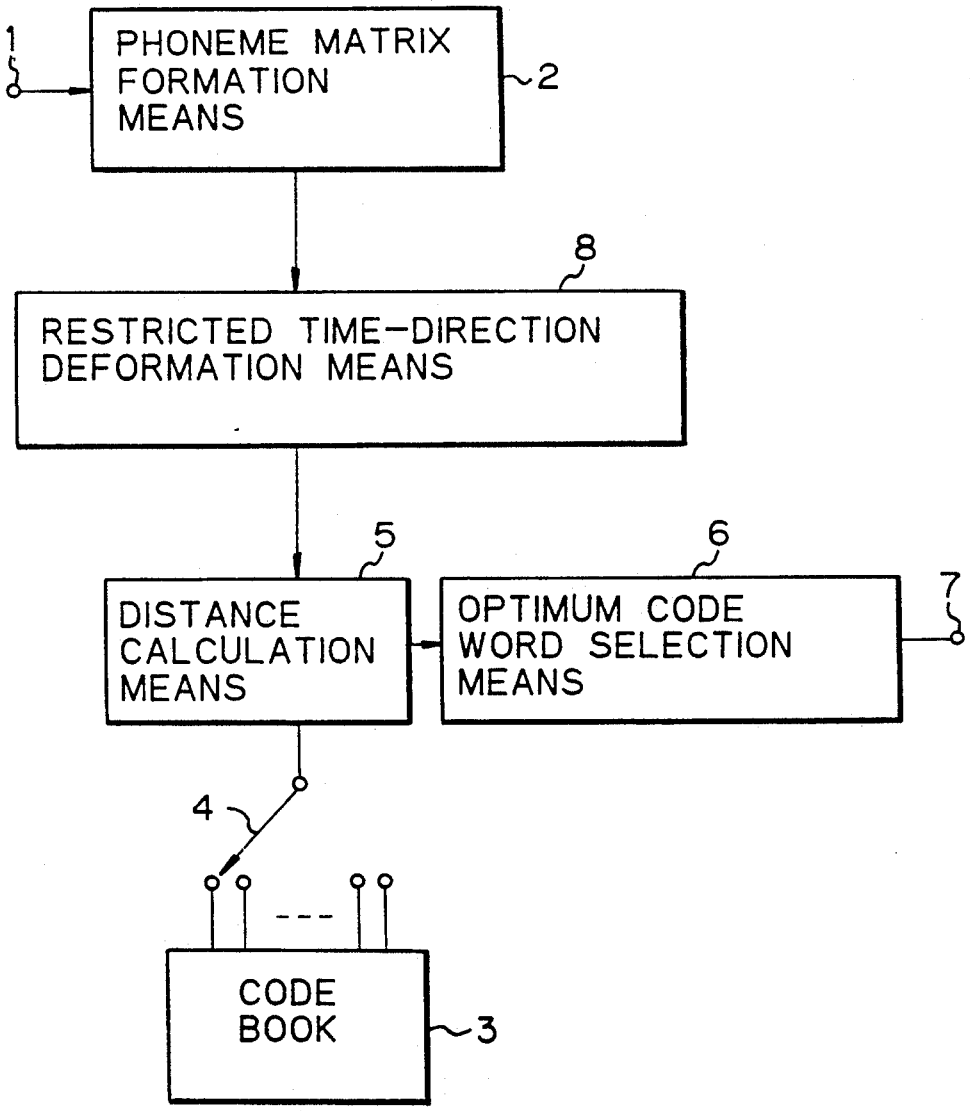
FIG. 3 is a block diagram of a voice spectrum envelop parameter encoder in accordance with an embodiment of the present invention.

An embodiment of the present invention will be described below with reference to the accompanying drawings. Referring to FIG. 3, there are provided an input terminal 1, a phoneme matrix formation means 2, a code book 3, a changeover switch 4, a distance calculation means 5, an optimum code word selection means 6 and an output terminal 7. These components are identical or corresponding to those indicated by the same reference characters in FIG. 1 and the description for them will not be repeated. A restricted time-direction deformation means 8 is provided which serves to process the phoneme matrix supplied from the phoneme matrix formation means 2 by finite N kinds of shifting/compression/expansion in time-direction previously given in a certain range such that the extent of deformation detected by auditory sense is small, thereby forming N deformed phoneme matrices. The restricted time-direction deformation means 8 outputs these matrices to the distance calculation means 5.

The operation of this apparatus will be described below. When phoneme vectors which are parameters representing information on the spectrum envelop of an input voice are input through the input terminal 1, the phoneme matrix formation means 2 accumulates input phoneme vectors with respect to groups of certain (L+2p) frames, and outputs a phoneme matrix composed of (L+2p) phoneme for each group of L frames. This phoneme matrix is supplied from the phoneme matrix formation means 2 to the restricted time-direction deformation means 8. The restricted time-direction deformation means 8 effects finite N kinds of shifting/compression/expansion in time-direction for the supplied phoneme matrix to form N deformed phoneme matrices.

Figure 4:
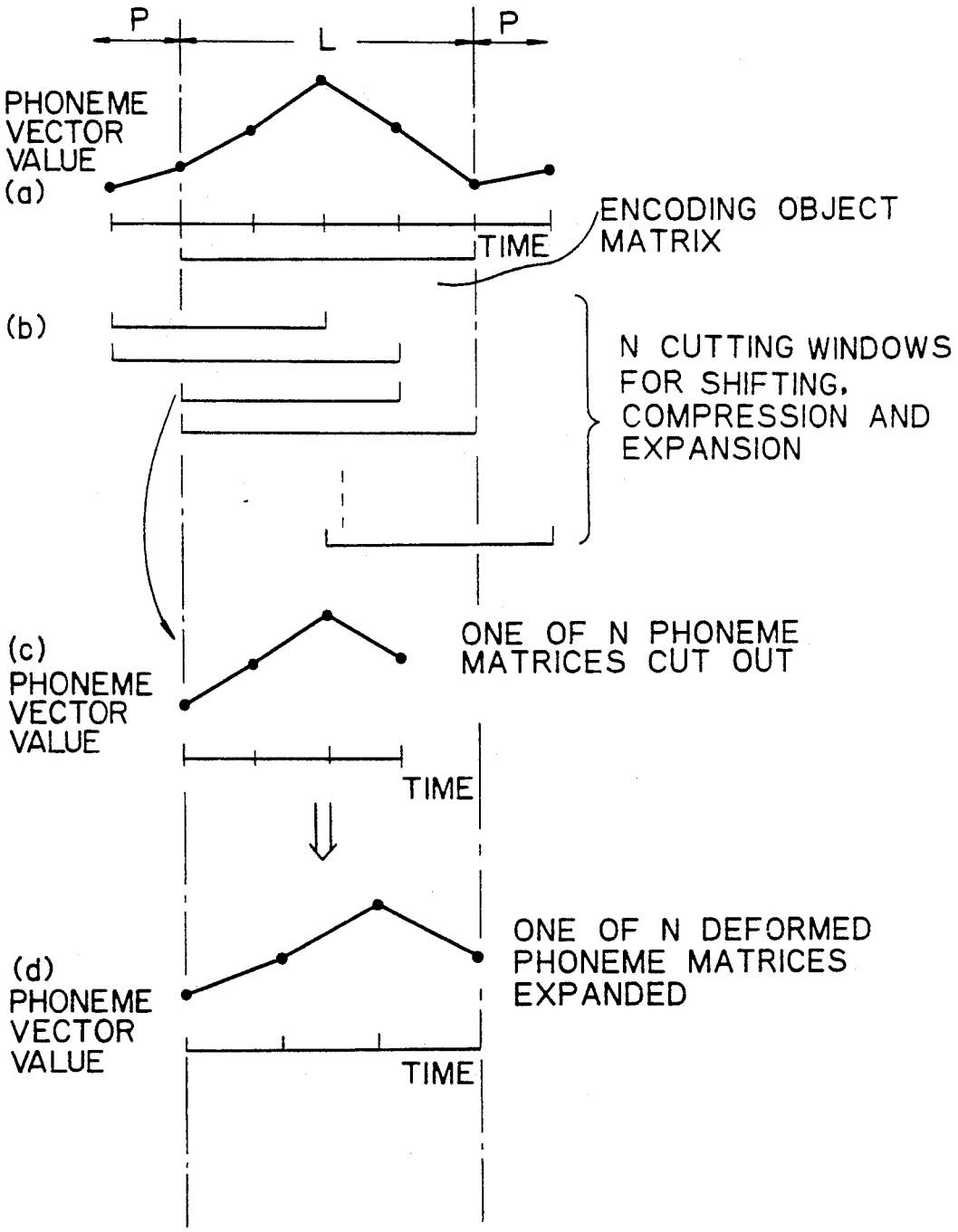
FIG. 4 is a diagram of the operation of the restricted time-direction deformation means.

FIG. 4 is a diagram of the operation of the restricted time-direction deformation means 8 which schematically shows a phoneme matrix while taking phoneme vectors one-dimensionally and setting L to 5 and p to 1. The abscissa represents time and the ordinate represents the phoneme vector value. From the 7 frame matrix which is the object of encoding shown in (a) of FIG. 4, N phoneme matrices one of which is as shown in (c) of FIG. 4 are cut out by using N types of cutting windows shown in (b) of FIG. 4. The cutting windows shown in (b) are previously given in a certain range such that the extent of deformation detected by auditory sense is small. Each of the phoneme matrices cut out is processed by, for example, linear compression/expansion so that it has L dimensions in time-direction, thereby forming N deformed phoneme matrices one of which is as shown in (d) of FIG. 4.

The deformed phoneme matrices thereby formed are supplied from the restricted time-direction deformation means 8 to the distance calculation means 5. On the other hand, M phoneme matrix code words stored in the code book 3 are successively read out through the changeover switch 4 to be input into the distance calculation means 5. The distance calculation means 5 successively calculates the distance between the N phoneme matrices and the M phoneme matrix code words and outputs the distances calculated to the optimum code word selection means 6. The optimum code word selection means 6 selects the phoneme matrix code word of the smallest distance value as an optimum phoneme matrix code word, and outputs the code word number thereof as the optimum phoneme matrix code number through the output terminal 7.

In the above-described embodiment, compression-/expansion of the cut-out matrices is effected as a kind of linear compression/expansion method. However, a plurality of kinds of compression/expansion method may be selected from a non-linear compression/expansion method, a compression/expansion method in which fixed phoneme portions are weighted, and other methods.

In the above-described embodiment, only the optimum phoneme matrix code number is output. However, information on time-direction deformation may be added to the output. In this case, it is necessary for the decoder to have a means for deforming the optimum phoneme matrix code word based on the received information on the time-direction deformation.

What is claimed is:

1. An apparatus for encoding voice spectrum parameters comprising:

means for combining in time direction a fixed number of phoneme vectors composed of spectrum parameters representing information on the spectrum of an input voice signal, to provide an input phoneme matrix;

means for performing a first finite number of deformations in time-direction of the input phoneme matrix, to output the first number of deformed phoneme matrices;

a code book for storing a second finite number of phoneme matrix code words;

distance calculation means for calculating the distances between each of the deformed phoneme matrices output from said means for performing deformations and each of the phoneme matrix code words; and optimum code word selection means for comparing the distances calculated by said distance calculation means, and for selecting for the input phoneme matrix one of the phoneme matrix code words having the smallest distance to the deformed phoneme matrices formed for the input phoneme matrix as an optimum phoneme matrix code word.

2. The apparatus of claim 1 wherein the distance calculation means reads the phoneme matrix code words from the code book in sequence.

3. The apparatus of claim 1 wherein the distance calculation means more particularly calculate Euclidean distance.

4. The apparatus of claim 1 wherein the deformations in the time direction of the input phoneme matrix are such that the extent of deformation detected by auditory sense is small.

5. The apparatus of claim 4, wherein the means for performing deformations in time direction includes means for cutting out phoneme matrices from the input phoneme matrix using a plurality of cutting windows, the number of which being said first finite number, and means for processing each of the cut out phoneme matrices by linear compression and expansion so as to form a plurality of deformed phoneme matrices, the number of which being said first finite number, each deformed phoneme matrix having the same dimension in time direction as the input phoneme matrix.

6. The apparatus of claim 4, wherein the means for performing deformations in time direction includes means for cutting out phoneme matrices from the input phoneme matrix using a plurality of cutting windows, the number of which being said first finite number, and means for processing each of the cut out phoneme matrices by non-linear compression and expansion so as to form a plurality of deformed phoneme matrices, the number of which being said first finite number, each deformed phoneme matrix having the same dimension in time direction as the input phoneme matrix.

7. The apparatus of claim 4, wherein the means for performing deformations in time direction includes means for cutting out phoneme matrices from the input phoneme matrix using a plurality of cutting windows, the number of which being said first finite number, and means for processing each of the cut out phoneme matrices by a compression and expansion method, in which fixed phoneme portions are weighted, so as to form a plurality of deformed phoneme matrices, the number of which being said first finite number, each deformed phoneme matrix having the same dimension in time direction as the input phoneme matrix.

8. The apparatus of claim 1 wherein the means for combining includes means for accumulating input phoneme vectors with respect to groups of a fixed number of frames, and outputs the input phoneme matrix composed of the fixed number of phonemes for each group of frames.

9. The apparatus of claim 1 wherein each code word in the code book has a corresponding code number wherein the output of the optimum code word selection means is the code number of the optimum phoneme matrix.

10. The apparatus of claim 9 wherein the output of the optimum code word selection means further includes an indication of the deformation used to obtain deformation in the time direction of the deformed phoneme matrix corresponding to the optimum phoneme matrix code word.

11. A method for encoding voice spectrum parameters comprising the steps of:

obtaining an input phoneme matrix from a fixed number of input phoneme vectors composed of spectrum parameters representing information on the spectrum of an input voice signal;

performing a first number of deformations in time-direction of the input phoneme matrix, to obtain the first number of deformed phoneme matrices, providing a code book which stores a second finite number of phoneme matrix code words;

calculating distances between each of the obtained deformed phoneme matrices and each of the phoneme matrix code words; and comparing the distances calculated and selecting for the input phoneme matrix one of the phoneme matrix code words having the smallest distance to the deformed phoneme matrices formed for the input phoneme matrix as an optimum phoneme matrix code.

12. The method of claim 11 wherein the step of calculating distances is performed for each of the phoneme matrix code words from the code book in sequence.

13. The method of claim 11 wherein the step of calculating is more particularly the step of calculating Euclidean distance.

14. The method of claim 11 wherein the deformations performed in the time direction of the input phoneme matrix are such that the extent of deformation detected by auditory sense is small.

15. The method of claim 14, wherein the step of performing deformations in time direction includes the step of cutting out phoneme matrices from the input phoneme matrix using a plurality of cutting windows, the number of which being said first finite number, and the step of processing each of the cut out phoneme matrices by linear compression and expansion so as to form a plurality of deformed phoneme matrices, the number of which being said first finite number, each deformed phoneme matrix having the same dimension in time direction as the input phoneme matrix.

16. The method of claim 14, wherein the step of performing deformations in time direction includes the step of cutting out phoneme matrices from the input phoneme matrix using a plurality of cutting windows, the number of which being said first finite number, and the step of processing each of the cut out phoneme matrices by non-linear compression and expansion so as to form a plurality of deformed phoneme matrices, the number of which being said first finite number, each deformed phoneme matrix having the same dimension in time direction as the input phoneme matrix.

17. The method of claim 14, wherein the step of performing deformations in time direction includes the step of cutting out phoneme matrices from the input phoneme matrix using a plurality of cutting windows, the number of which being said first finite number, and the step of processing each of the cut out phoneme matrices by a compression and expansion method, in which fixed phoneme portions are weighted, so as to form the a plurality of deformed phoneme matrices, the number of which being said first finite number, each deformed phoneme matrix having the same dimension in time direction as the input phoneme matrix.

18. The method of claim 11 wherein the step of obtaining an input phoneme matrix includes the step of accumulating input phoneme vectors with respect to groups of a fixed number of frames, and the step of providing the input phoneme matrix composed of the fixed number of phonemes for each group of frames.

19. The method of claim 11, wherein the code words in the code book each have a corresponding code number further comprising the step of providing as an output the code number of the optimum phoneme matrix.

20. The method of claim 19 further comprising the step of providing as an output an indication of the deformation used to obtain deformation in the time direction of the deformed phoneme matrix corresponding to the optimum phoneme matrix code word.

* * * * *